US011284189B1

(12) United States Patent
Zhang

(10) Patent No.: US 11,284,189 B1
(45) Date of Patent: Mar. 22, 2022

(54) BONE CONDUCTION LOUDSPEAKER AND EARPHONE

(71) Applicant: Shenzhen Yuyuantong Technology Co., Ltd., Guangdong (CN)

(72) Inventor: Fangfang Zhang, Shenzhen (CN)

(73) Assignee: Shenzhen Yuyuantong Technology Co., Ltd.

( * ) Notice: Subject to any disclaimer, the term of this patent is extended or adjusted under 35 U.S.C. 154(b) by 0 days.

(21) Appl. No.: 17/096,942

(22) Filed: Nov. 12, 2020

(51) Int. Cl.
*H04R 1/46* (2006.01)
*H04R 1/10* (2006.01)

(52) U.S. Cl.
CPC ..... *H04R 1/46* (2013.01); *H04R 1/1016* (2013.01); *H04R 2460/13* (2013.01)

(58) Field of Classification Search
CPC combination set(s) only.
See application file for complete search history.

(56) References Cited

U.S. PATENT DOCUMENTS 5,757,935 A * 5/1998 Kang ..... H04R 25/00 381/151
8,447,061 B2 * 5/2013 Lee ..... H04R 1/1016 381/380
2006/0165246 A1 * 7/2006 Lee ..... H04R 9/066 381/151
2017/0164088 A1 * 6/2017 Fukuda ..... H04R 1/1016
2021/0127184 A1 * 4/2021 Fukuda ..... H04R 1/00
2021/0152909 A1 * 5/2021 Peng ..... H04R 1/10

FOREIGN PATENT DOCUMENTS

CN 104967934 * 10/2015 ..... H04R 1/10

* cited by examiner

*Primary Examiner* — Angelica M McKinney
(74) *Attorney, Agent, or Firm* — Timothy T. Wang; Ni, Wang & Massand, PLLC

(57) ABSTRACT

A bone conduction loudspeaker, comprising an upper shell, a lower shell coupled to the upper shell and a sound transmission piece coupled to at least one of magnet and a coil, wherein a periphery of the sound transmission piece is provided with a flange bent to a side, and an outer side face having an opening within the upper shell and having a snap slot complementary to the flange, and wherein the sound transmission piece is sleeved over the opening and fixed through a snap-fit between the flange and the snap slot.

7 Claims, 1 Drawing Sheet

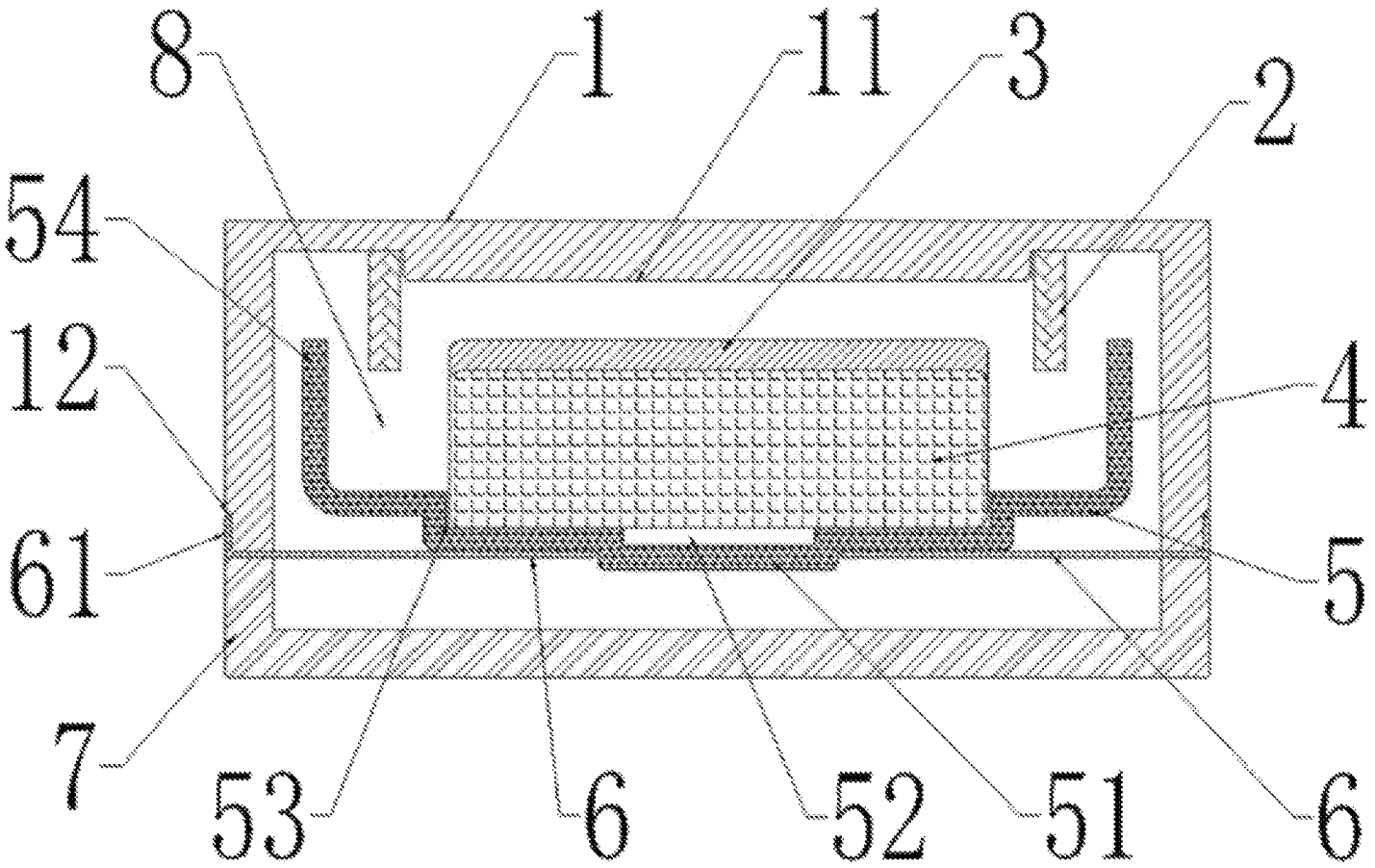
1
11
3
2
8
54
12
61
7
4
5
6
51
52
6
53

BONE CONDUCTION LOUDSPEAKER AND EARPHONE

FIELD OF THE INVENTION

The utility model relates to the field of bone conduction earphones, in particular to a bone conduction loudspeaker.

BACKGROUND OF THE INVENTION

Bone conduction earphones convert electrical signals into vibration signals, and allow people to hear sounds through contact with the cochlea of human bodies. The sounds do not need to be transmitted through air, and the earphones do not need to be placed into or over the ear canal. However, the existing structure of bone conduction loudspeaker with adjustable high and low frequency sound effects typically employs a positioning frame bonded by glue to a sound transmission piece, which is environmentally unfriendly, wastes manual labor and time, is loosely fixed, unreliable, unstable and may eventually de-bond.

Traditional bone conduction sound transmission devices form a planar structure, which is fixed by a slot defined at an end of an upper shell through the wall of the upper shell. This may lead to misalignment during assembly due to the thickness of the sound transmission piece being only about 0.1 mm, so that the slot position may be misaligned during assembly, in operation, the bone conduction loudspeaker is prone to noise generation and the manufacturing tolerance requirement of the mold is stringent.

A lower shell is typically used to compress the sound transmission piece. Because the lower shell is typically made of plastic, this increases the likelihood that due to tolerances in the mold manufacturing process, noise or unstable sound quality may result.

SUMMARY OF THE INVENTION

A bone conduction loudspeaker, comprising an upper shell, a lower shell coupled to the upper shell and a sound transmission piece coupled to at least one of magnet and a coil, wherein a periphery of the sound transmission piece is provided with a flange bent to a side, and an outer side face having an opening within the upper shell and having a snap slot complementary to the flange, and wherein the sound transmission piece is sleeved over the opening and fixed through a snap-fit between the flange and the snap slot.

BRIEF DESCRIPTION OF THE DRAWINGS

The specific embodiment of the utility model will be further described in detail with reference to the attached drawings.

FIG. 1 is an example structural schematic view of the disclosed device.

DETAILED DESCRIPTION OF THE INVENTION

For easy understanding the technical problems to be solved, the technical solution adopted and the technical effects obtained by the utility model, the specific implementation of the utility model will be further explained with reference to the specific drawings.

It should be noted that for convenience of description, only some structures related to the utility model are shown in the drawings, instead of all structures.

One example bone conduction loudspeaker allows alignment and mitigates generated noise.

In one example the loudspeaker which comprises an upper shell, a lower shell and a sound transmission piece connected with a magnet or a coil, wherein a periphery of the sound transmission piece is provided with a flange bent to one side; an outer side face of an opening in the upper shell is provided with a snap slot which matched with the flange, the sound transmission piece is sleeved over the opening and is fixed through the snap-fit between the flange and the snap slot.

The sound transmission piece may be connected with the magnet through a positioning frame. The positioning frame may include a U-shaped structure. A bottom of the positioning frame may have a first groove for accommodating the magnet, and the magnet may be fixed in the first groove. A bottom of the first groove may have an outward protrusion. A middle portion of the sound transmission piece may have a through hole for being sleeved over the outward protrusion for positioning. The sound transmission piece may be sleeved over the outward protrusion through the through hole for positioning.

Contact surfaces of the sound transmission piece and the positioning frame may be fixed by welding. An inner side of the outward protrusion on the positioning frame may have a second groove, so that there is a gap between the outward protrusion and the magnet. A bottom of the upper shell may have an inward bump for fixing the coil, and the coil is sleeved over the inward bump. A cavity may accommodate the inserted coil between the magnet and the side wall of the positioning frame, and the coil may be inserted into the cavity and sleeved outside the magnet. A cover plate may cover the magnet. The bone conduction loudspeaker may include a bone conduction earphone.

As depicted in FIG. 1, in an example embodiment, a bone conduction loudspeaker is provided, which comprises an upper shell 1 and a lower shell 7, which are engaged together to form an internal cavity. An inward bump 11 is provided at a bottom of the upper shell 1. A coil 2 is sleeved over the inward bump 11. A positioning frame 5 is arranged below the coil in the middle of the cavity. The positioning frame 5 is a U-shaped structure and is provided with a first groove 53 for accommodating a magnet 4. The magnet 4 is arranged and fixed in the first groove 53.

A middle portion of a bottom of the first groove 53 may be provided with an outward protrusion 51 for positioning a sound transmission piece 6. A second groove 52 may define in the inner side of the outward protrusion 51 of the positioning frame 5, so that there is a gap between the outward protrusion 51 and the magnet 4.

A cavity 8 for accommodating the coil 2 may be defined between the magnet 4 and the side wall 54 of the positioning frame 5, and the coil 2 may be sleeved outside the magnet 4.

The magnet 4 may also be provided with a cover plate 3. The cover plate 3 may be snapped onto the magnet 4. The sound transmission piece 6 may be installed on the underside of the positioning frame 5, and a through hole is defined in a middle portion of the sound transmission piece 6. The sound transmission piece 6 may be positioned through the cooperation of the through hole and the outward protrusion. The through hole is sleeved over the outward protrusion.

Contact surfaces between the sound transmission piece 6 and the positioning frame 5 may be fixed by welding, preferably by laser spot welding. Fixing directly by the laser spot welding may allow the reliability to be significantly improved. Detachment properties may be improved. Labor and materials may be saved and the weld may be firm and not easy damaged.

A periphery of the sound transmission piece 6 may be provided with a flange 61 bent to one side. An outer side face of an opening of the upper shell 1 may be provided with a snap slot 12 matched with the flange. The sound transmission piece 6 may be sleeved over the opening of the upper shell 1. The flange 61 may be snapped and fixed with the snap slot 12. The lower shell 7 may be arranged under the sound transmission piece 6 and in close contact with the sound transmission piece 6. A reasonable tolerance may exist between the flange 61 and the snap slot 12. During assembling, the sound quality can be tested before assembly in order to improve product yield.

The lower shell 7 does not press and fix the sound transmission piece 6, and sound transmission effect may be achieved as long as there is contact. The sound quality of a traditional loudspeaker cannot be tested until it is assembled. This system allows for the testing of the sound quality of the product and determination whether the product is qualified or not before the lower shell 7 is installed. This testing may save manual labor and material compared with the traditional systems wherein the test is made after complete assembling and if it is not qualified, disassembly and reassembly are redone. The system may provide a bone conduction earphone which employs the bone conduction loudspeaker.

In the loudspeaker depicted, the sound transmission piece is firmly and reliably fixed, has good stability and is not easy loosened, and thus the sound transmission piece may be difficult to misalign, thus reducing generated noise.

The above embodiments and drawings are only used to illustrate the technical solution of the utility model, and do not limit the utility model. It should be noted that those of ordinary skills in the art can modify the technical solution described in the foregoing embodiments or make equivalent substitutions for some or all of the technical features, and these modifications or substitutions should be included in the scope of protection of the utility model claims.

What is claimed is:

1. A bone conduction loudspeaker, comprising:

an upper shell;

a lower shell coupled to the upper shell; and a sound transmission piece coupled to a magnet and a coil, wherein a periphery of the sound transmission piece is provided with a flange bent to a side, and an outer side face having an opening within the upper shell and having a snap slot complementary to the flange, and wherein the sound transmission piece is sleeved over the opening and fixed through snap-fit between the flange and the snap slot and the sound transmission piece is connected with the magnet via a positioning frame;

wherein the positioning frame forms a U-shaped structure, a bottom of the positioning frame having a first groove to receive the magnet, and the magnet is arranged and fixed in the first groove; and wherein a bottom of the first groove has an outward protrusion, and a middle portion of the sound transmission piece has a through hole sleeved over the outward protrusion, and the sound transmission piece is sleeved over the outward protrusion through the through hole.

2. The bone conduction loudspeaker of claim 1, wherein contact surfaces between the sound transmission piece and the positioning frame are fixed by welding.

3. The bone conduction loudspeaker of claim 1, wherein the positioning frame has a second groove in an inner side of the outward protrusion, providing a gap between the outward protrusion and the magnet.

4. The bone conduction loudspeaker of claim 1, wherein a bottom of the upper shell has an inward bump to receive the coil, and the coil is sleeved over the inward bump.

5. The bone conduction loudspeaker of claim 4, wherein a cavity accommodates an inserted the coil between the magnet and a side wall of the positioning frame, and the coil is retained by the cavity and sleeved outside the magnet.

6. The bone conduction loudspeaker of claim 5, further comprising a cover plate on the magnet.

7. The bone conduction loudspeaker of claim 1, further comprising an earphone.

* * * * *